US005221179A

United States Patent [19]

Ikegami et al.

[11] Patent Number: 5,221,179

[45] Date of Patent: Jun. 22, 1993

[54] VACUUM PUMP

[75] Inventors: Tatsuji Ikegami; Tetsuro Ohbayashi; Keiichi Yoshida, all of Osaka; Masashi Iguchi, Tokyo, all of Japan

[73] Assignee: Osaka Vacuum, Ltd., Osaka, Japan

[21] Appl. No.: 769,409

[22] Filed: Oct. 1, 1991

Related U.S. Application Data

[60] Division of Ser. No. 582,783, Sep. 14, 1990, abandoned, which is a continuation of Ser. No. 379,072, Jul. 13, 1989, Pat. No. 5,074,747.

[30] Foreign Application Priority Data

| | | | |
|---|---|---|---|
| Jul. 13, 1988 | [JP] | Japan | 63-174148 |
| Jul. 26, 1988 | [JP] | Japan | 63-186632 |
| Aug. 17, 1988 | [JP] | Japan | 63-204128 |
| Sep. 12, 1988 | [JP] | Japan | 63-226533 |
| Dec. 16, 1988 | [JP] | Japan | 63-316277 |

[51] Int. Cl.[5] ..... F01D 1/00

[52] U.S. Cl. ..... 415/55.1; 415/90

[58] Field of Search ..... 415/55.1, 55.2, 55.3, 415/55.4, 55.5, 55.6, 55.7, 90

[56] References Cited

U.S. PATENT DOCUMENTS

| | | | |
|---|---|---|---|
| 1,069,408 | 8/1913 | Gaede | 415/90 |
| 1,665,687 | 4/1929 | Derrick | 415/55.7 |
| 2,283,844 | 5/1942 | Brady, Jr. | 415/55.1 |
| 2,396,319 | 3/1946 | Edwards et al. | 415/55.1 |
| 2,684,034 | 7/1954 | Roth | 415/55.1 |
| 2,842,062 | 7/1958 | Wright | 415/55.4 |
| 3,283,844 | 11/1966 | Brady, Jr. | 415/55.1 |
| 3,405,644 | 10/1968 | Skinner | 415/55.2 |
| 3,477,636 | 11/1969 | Gessner | 415/55.4 |
| 3,915,589 | 10/1975 | Vander Linden | 415/55.6 |
| 4,204,800 | 5/1980 | Bentele et al. | 415/55.5 |
| 4,325,672 | 4/1982 | Sixsmith et al. | 415/55.1 |
| 4,478,550 | 10/1984 | Watanabe et al. | 415/55.2 |
| 4,591,311 | 5/1986 | Matsuda | 415/55.5 |
| 4,673,333 | 6/1987 | Kluge | 415/55.1 |
| 4,732,529 | 3/1988 | Narita et al. | 415/90 |

FOREIGN PATENT DOCUMENTS

| | | | |
|---|---|---|---|
| 2310481 | 12/1976 | France | 415/90 |
| 247893 | 11/1986 | Japan | 415/90 |
| 0258186 | 11/1987 | Japan | 415/90 |
| 0055396 | 3/1988 | Japan | 415/90 |
| 0147991 | 6/1988 | Japan | 415/90 |
| 159695 | 7/1988 | Japan | 415/90 |
| 1373955 | 11/1974 | United Kingdom | 415/90 |

*Primary Examiner*—Edward K. Look
*Assistant Examiner*—Hoang Nguyen
*Attorney, Agent, or Firm*—Oblon, Spivak, McClelland, Maier & Neustadt

[57] ABSTRACT

Disclosed is a vacuum pump having a peripheral groove vacuum pump unit which includes a casing provided with an inlet port and an outlet port; a rotor disposed within the casing and including a rotor shaft journaled on the casing, a rotor body fixed to the rotor shaft and provided integrally with a rotor disk; and a stator fixedly disposed within the casing and provided with an annular groove receiving the peripheral portion of the rotor disk. Both sides of the peripheral portion of the rotor disk are cut in steps or portions of the side walls of the annular groove corresponding to the peripheral portion of the rotor disk are cut in annular recesses to form flow passages on both sides of the peripheral portion of the rotor disk. Partitions are projected from the stator into the flow passages. The starting ends of the flow passages on the inlet side of the partitions communicate with the inlet port, and the terminating ends of the same on the outlet side of the partitions communicate with the outlet port. The vacuum pump is capable of operating at a high pumping speed. Spaces between the peripheral portion of the rotor disk and the inner surfaces of the annular groove of the stator need not be sealed and large clearances may be formed therebetween, so that the components of the vacuum pump can easily be machined without requiring high machining accuracies.

5 Claims, 14 Drawing Sheets

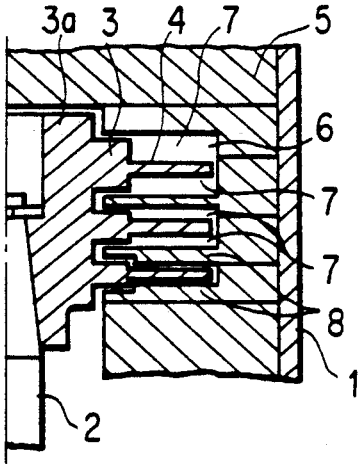
FIG. 21
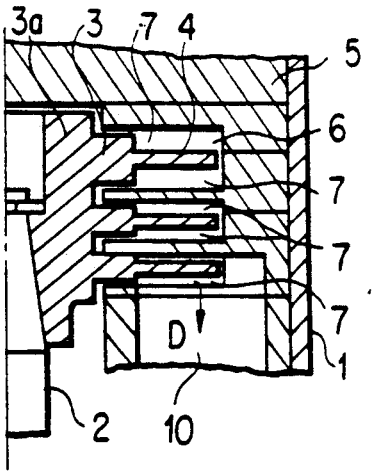
FIG. 22
FIG. 23
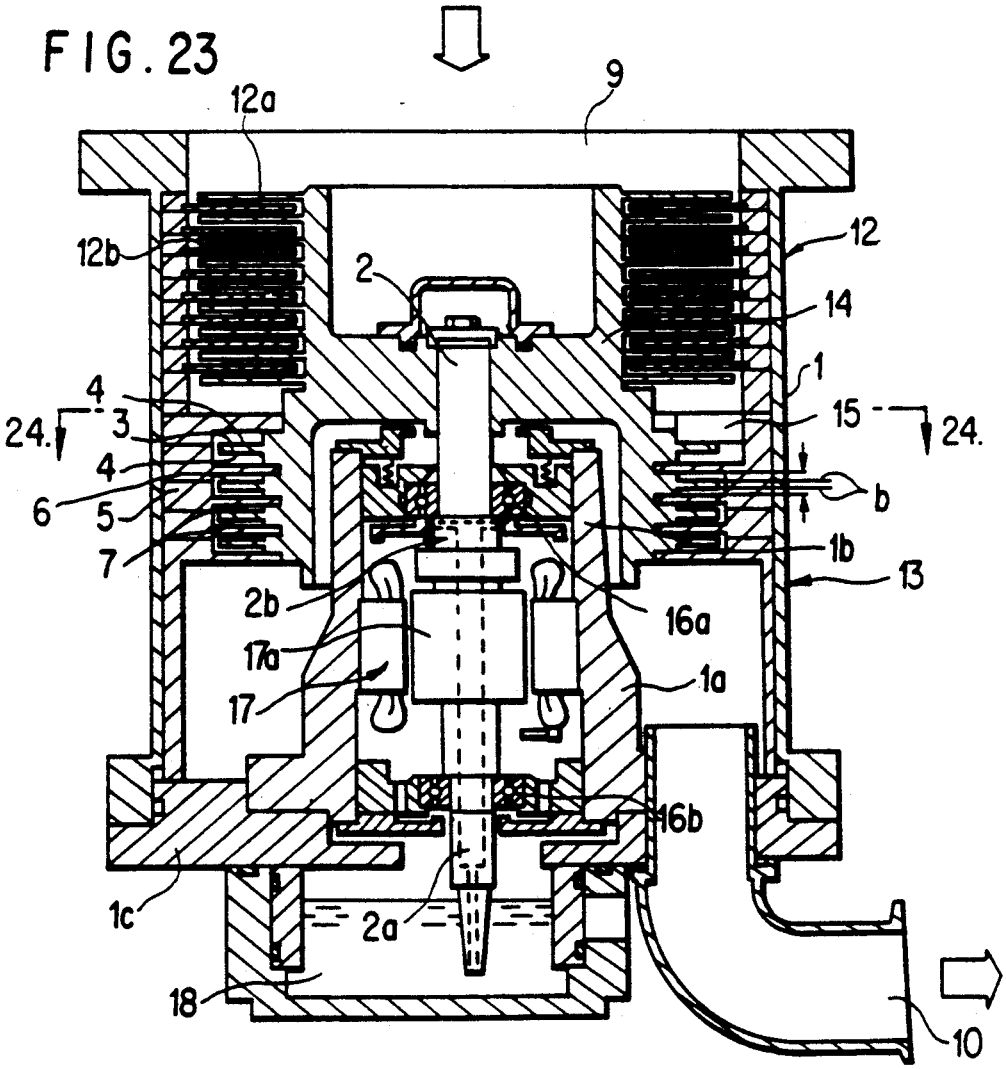

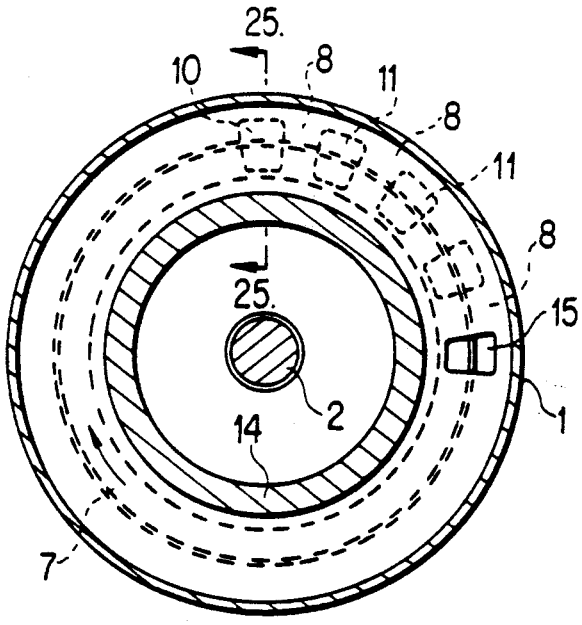
FIG. 24
FIG. 25
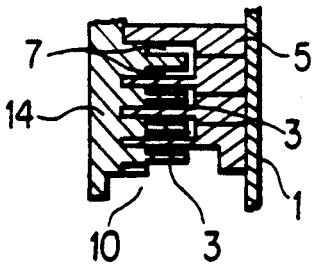
FIG. 26
PRIOR ART
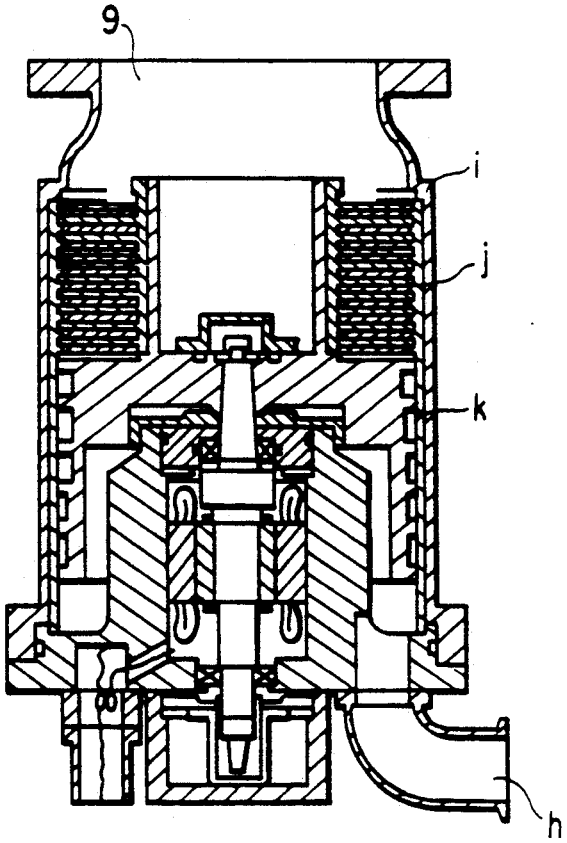

VACUUM PUMP

This is a division of application Ser. No. 07/582,783, now abandoned, filed on Sep. 14, 1990, which is a continuation of Ser. No. 07/379,072, filed on Jul. 13, 1989, now abandoned, now U.S. Pat. No. 5,074,747.

BACKGROUND OF THE INVENTION

1. Field of the Invention

The present invention relates to a useful vacuum pump, for experimental or industrial vacuum apparatuses, such as particle accelerators, experimental and research apparatuses for nuclear fusion or isotope separation, electron microscopes, and analyzing and measuring apparatuses such as surface analyzers, and semiconductor manufacturing systems capable of surely creating a clean vacuum under intake pressure conditions ranging from atmospheric pressure through a high vacuum to a ultra-high vacuum.

2. Discussion of the Background

Shown in FIG. 50 is an exemplary conventional vacuum pump comprising a casing a, a rotor shaft c journaled on the casing a, and a rotor disk b fixedly mounted on the rotor shaft c within the casing a. Spiral grooves d are formed respectively in the opposite inner surfaces of the casing a. The outer ends of the spiral grooves d connect with an inlet port e, and the inner ends of the spiral grooves d connect respectively with outlet port f. When the rotor disk b is rotated, gas sucked through the inlet port e is compressed between the spiral grooves d and the rotor disk b, and then the compressed gas is discharged through the outlet ports f.

To provide the conventional vacuum pump with a high compressive performance, the spiral grooves d must be formed of a sufficiently large length, and hence the spiral grooves d cannot be formed with a large width. When the depth of the spiral grooves d is large relative to the width of the same, the pumping performance of the vacuum pump is deteriorated. Accordingly, it is impossible to form the spiral grooves over a large sectional area. When a plurality of these vacuum pumps are combined in a multi-stage construction to provide a multi-stage vacuum pump having a high compression ratio, connecting passages of a complicated construction must be formed between the adjacent rotor chambers of the vacuum pump when spiral grooves are formed in the opposite inner surfaces of each rotor chamber. When parallel action of both sides of the rotor disk is impossible, it is difficult to provide the vacuum pump with a high pumping speed. When the sectional area of the spiral grooves d is increased to provide a vacuum pump having a high pumping speed, the diameter of the rotor disk b must be increased accordingly, and hence the size of the vacuum pump is increased.

SUMMARY OF THE INVENTION

It is a first object of the present invention to provide a vacuum pump capable of operating at a high pumping speed under flow conditions ranging from a molecular flow mode to a viscous flow mode.

It is a second object of the present invention to provide a compact vacuum pump requiring no sealing construction between the edge of a rotor disk and the inner surface of a recess formed in a stator disposed opposite the rotor disk and allowing a large clearance therebetween, and not requiring high machining accuracy to facilitate machining in manufacturing the vacuum pump.

It is a third object of the present invention to provide a dry vacuum pump requiring pump oil and lubricating oil not at all in portion in direct contact with gas, capable of readily creating a clean, dry vacuum and which is free from contamination by hazardous gases.

It is a fourth object of the present invention to provide the capability of operating normally and discharging particles through an outlet port in case the particles are sucked together with a process gas therein or the particles are produced by chemical reaction during operation.

To achieve the foregoing objects, the present invention provides a vacuum pump having a peripheral groove vacuum pump unit comprising a casing provided with an inlet port and an outlet port; a rotor comprising a rotor shaft journaled on the casing, a rotor disk fixedly mounted on the rotor shaft; and a stator fixedly provided within the casing and provided with a recess for receiving the rotor disk therein; wherein both sides of the periphery of the rotor disk are recessed in steps or an annular groove is formed in the recess of the stator at a position corresponding to both sides of the periphery of the rotor disk so as to form flow passages, a partition is projected from the stator into the flow passages, a starting end of the flow passage on one side of the partition is connected with the inlet port, and the terminating end of the flow passage on the other side of the portion is connected with the outlet port.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 21 is a sectional view taken on line O-XXI in FIG. 15;

FIG. 22 is a sectional view taken on line O-XXII in FIG. 15;

FIG. 23 is a general sectional view of a vacuum pump in a sixth embodiment according to the present invention;

FIG. 24 is a sectional view taken on line XXIV—XXIV in FIG. 23;

FIG. 25 is a sectional view taken on line XXV—XXV in FIG. 24;

FIG. 26 is a sectional view of a conventional compound molecular pump;

DESCRIPTION OF THE PREFERRED EMBODIMENTS

First Embodiment (FIGS. 1 to 4)

Figure 1:
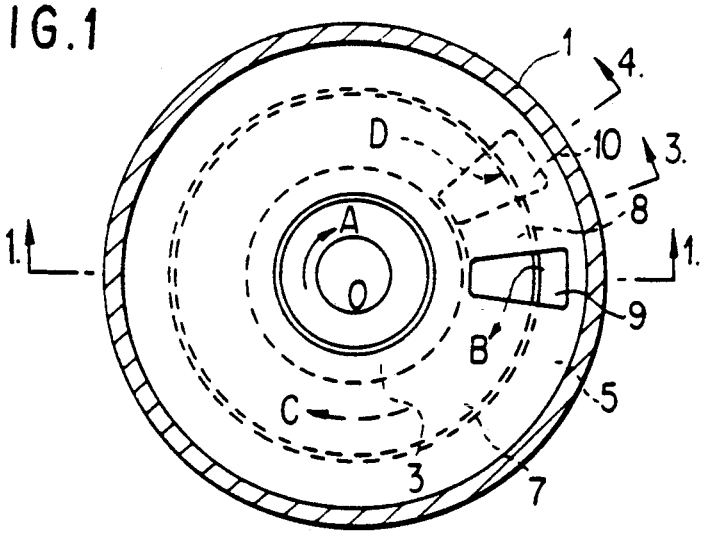
FIG. 1 is a plan view of an essential portion of a vacuum pump in a first embodiment according to the present invention.
Figure 2:
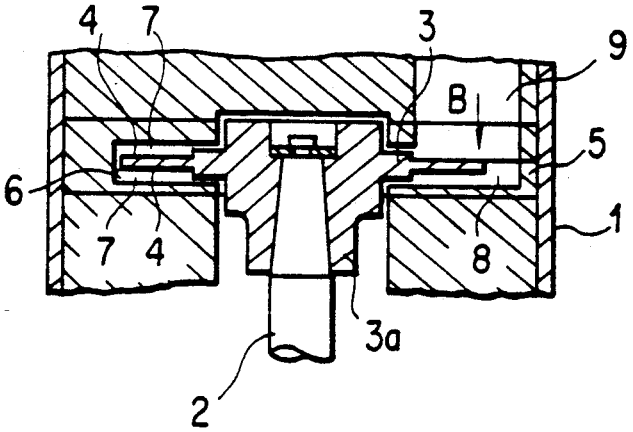
FIG. 2 is a sectional view taken on line I-II in FIG. 1.
Figure 3:
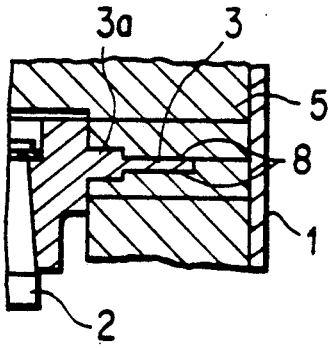
FIG. 3 is a sectional view taken on line O-III in FIG. 1.
Figure 4:
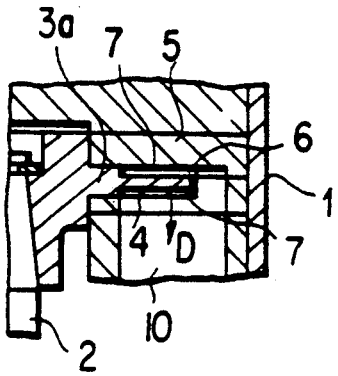
FIG. 4 is a sectional view taken on line O-IV in FIG. 1.

A vacuum pump in a first embodiment comprises a rotor shaft 2 journaled on a casing 1 and operatively connected to a motor at the lower end, as viewed in FIG. 1 thereof, a rotor disk 3 having a boss 3*a* and fixed to the upper end of the rotor shaft 2, and a stator 5 fixed to the inner surface of the casing 1. Both sides of the periphery of the rotor disk 3 are recessed to form radially steps 4 extending of substantially uniform thickness. An annular groove 6 is formed in the inner circumference of the stator 5 at a position corresponding to the rotor disk 3 to receive the rotor disk 3. Passages 7 are formed between the surfaces of the annular groove 6 and the corresponding steps 4 formed on both sides of the periphery of the rotor disk 3, respectively. A pair of partitions 8 are projected from the stator 5 across the flow passages 7, respectively and have an opening formed therein through which the rotor disk 3 rotates. The starting ends of the flow passages 7 on one side of the partitions 8, namely, portions of the flow passages 7 immediately after the partitions 8 with respect to the direction of rotation of the rotor disk 3, are connected with an inlet port 9, and the terminating ends of the flow passages 7 on the other side of the partitions 8, namely portions of the flow passages 7 immediately before the partitions 8 with respect to the direction of rotation of the rotor disk 3, communicate with an outlet port 10.

When the rotor disk 3 is driven by the motor for rotation at a high peripheral speed 0.1 to 1.0 times the average molecular velocity of the gas in the direction of an arrow A (see FIG. 1), molecules of the gas are exposed to the action of the surfaces of the steps 4, namely, both sides of the periphery of the rotor disk 3 moving at the highest surface speed, and are transported by a molecular drag effect owing to friction between the molecules of the gas. Accordingly, the gas sucked through the inlet port 9 as indicated by an arrow B (see FIGS. 1 and 2) is compressed and transported along the flow passages 7 in the direction of an arrow C (see FIG. 1) and the compressed gas is discharged through the outlet port 10 as indicated by an arrow D (see FIGS. 1 and 4). Thus, the vacuum pump is capable of evacuating at a high pumping speed in the pressure range corresponding to flow conditions ranging from molecular flow mode to viscous flow mode. Experimental operation of the vacuum pump has proved that the compression ratio of the vacuum pump is 10 or greater under a flow condition in the range of molecular flow mode to viscous flow mode.

Furthermore, the construction of the vacuum pump allows the intake port to be formed of a large size.

Figure 5:
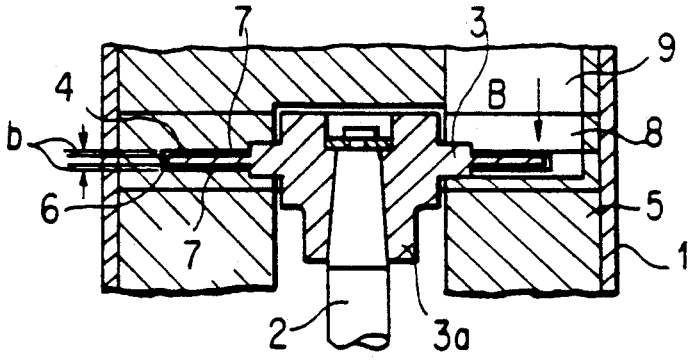
FIG. 5 is a sectional view, similar to FIG. 2, of a vacuum pump in a second embodiment according to the present invention.
Figure 6:
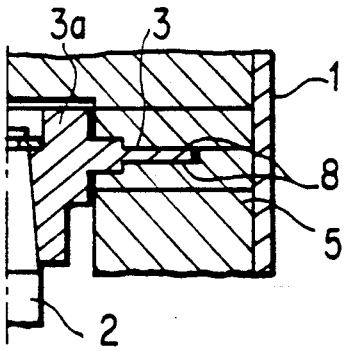
FIG. 6 is a sectional view of the vacuum pump of FIG. 5, corresponding to FIG. 3.
Figure 7:
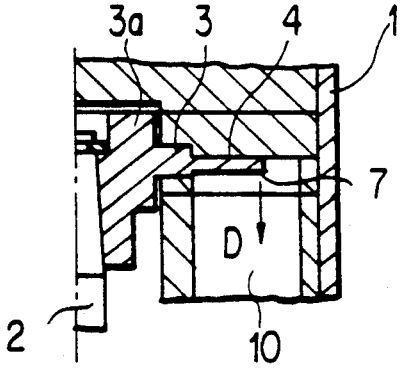
FIG. 7 is a sectional view of the vacuum pump of FIG. 5, corresponding to FIG. 4.

Second Embodiment (FIGS. 5 to 7)

A vacuum pump in the second embodiment is substantially the same in construction as the vacuum pump in the first embodiment. In the vacuum pump in the second embodiment, the thickness b of the flow passages 7, namely, the clearance between the surfaces of the periphery of the rotor disk 3 and the corresponding surfaces of the stator 5, is decreased gradually from the starting ends of the flow passages 7 toward the terminating ends of the same. When the rotor disk 3 is rotated at a high rotating speed, the pressure within the flow passages 7 increases gradually from the starting ends toward the terminating ends of the passages 7 and thereby the mean free path $\lambda$ of the gas is decreased accordingly. Consequently, the ratio $b/\lambda$ is maintained at an optimum value, and the vacuum pump in the second embodiment has a further enhanced transporting effect and improved pumping and compressing performance as compared with those of the vacuum pump in the first embodiment.

Figure 8:
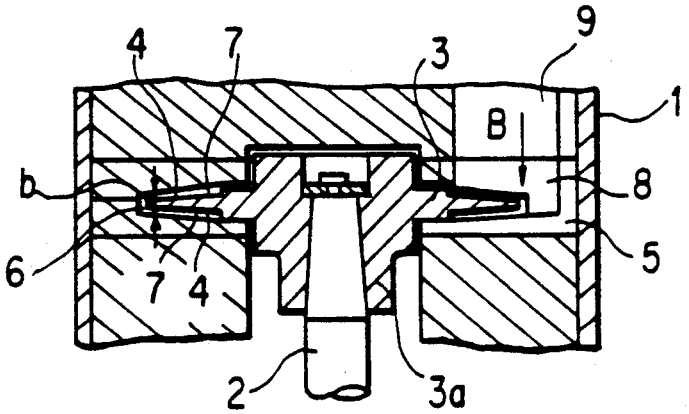
FIG. 8 is a sectional view, similar to FIG. 2, of a vacuum pump in a third embodiment according to the present invention.
Figure 9:
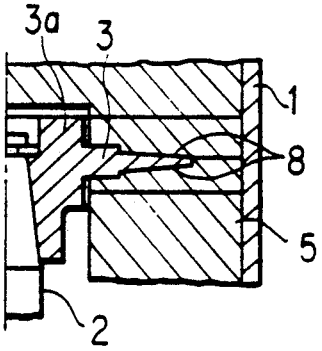
FIG. 9 is a sectional view of the vacuum pump of FIG. 8, corresponding to FIG. 3.
Figure 10:
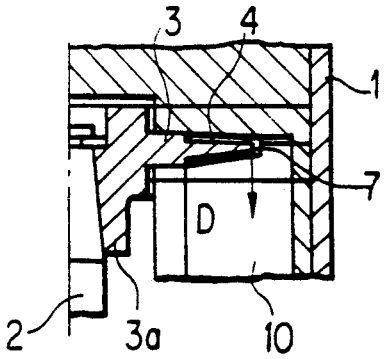
FIG. 10 is a sectional view of the vacuum pump of FIG. 8, corresponding to FIG. 4.
Figure 11:
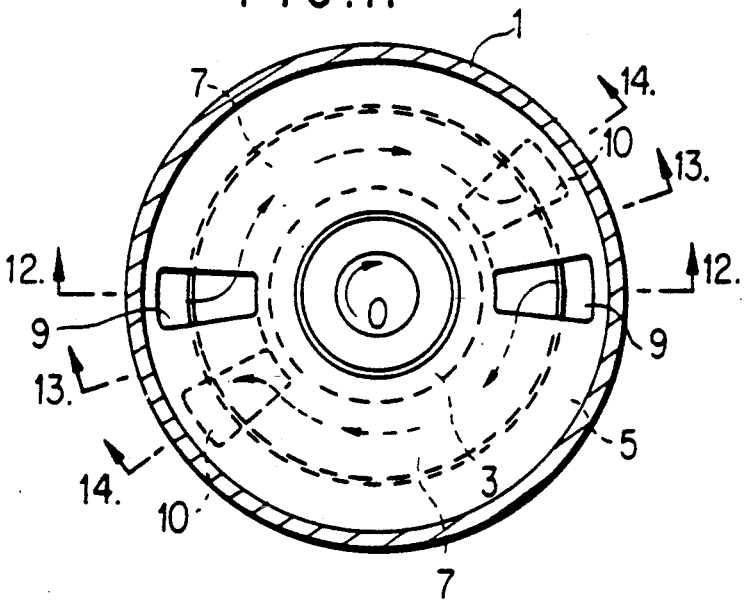
FIG. 11 is a plan view of an essential portion of a vacuum pump in a fourth embodiment according to the present invention.
Figure 12:
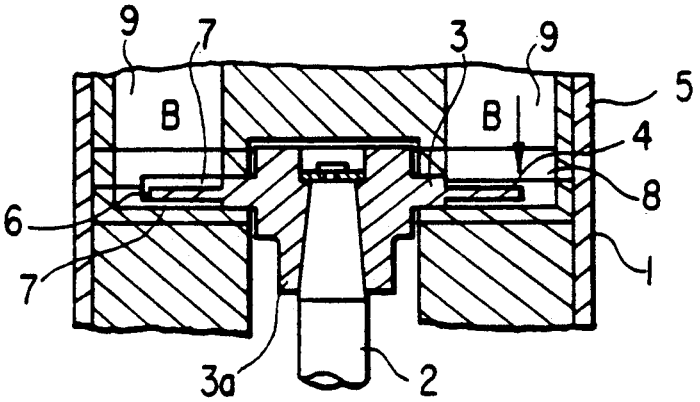
FIG. 12 is a sectional view taken on line XII—XII in FIG. 11.
Figure 13:
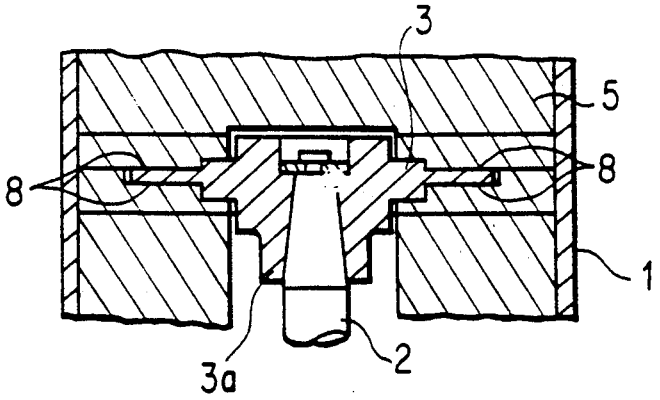
FIG. 13 is a sectional view taken on line XIII—XIII in FIG. 11.
Figure 14:
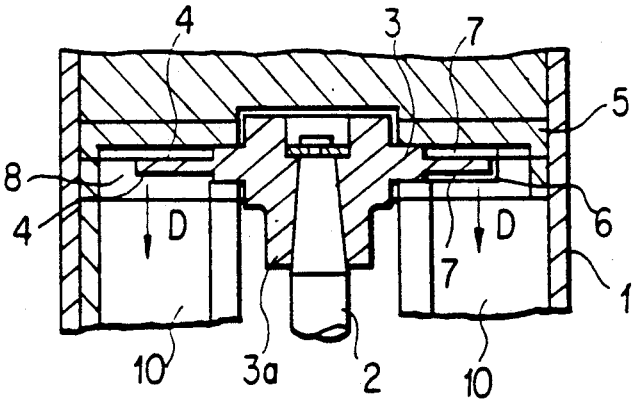
FIG. 14 is a sectional view taken on line XIV—XIV in FIG. 11.
Figure 15:
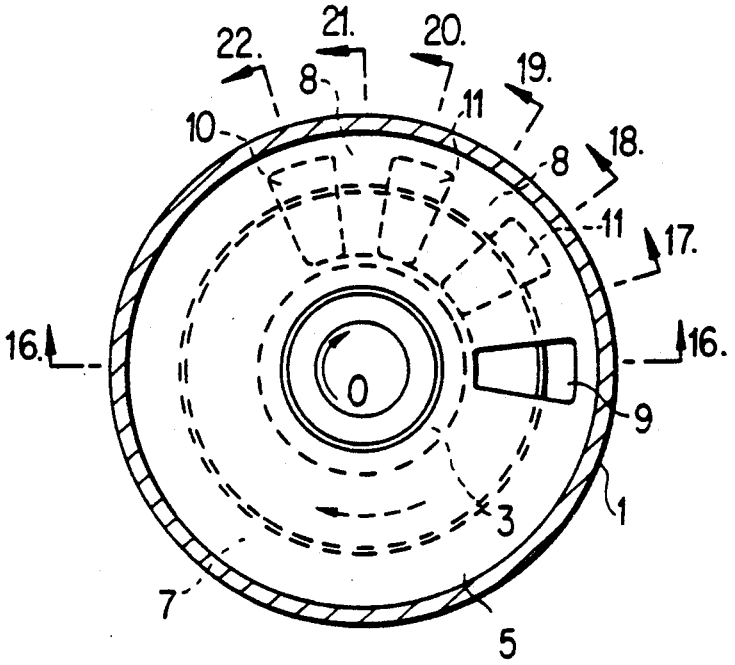
FIG. 15 is a plan view of an essential portion of a vacuum pump in a fifth embodiment according to the present invention.
Figure 16:
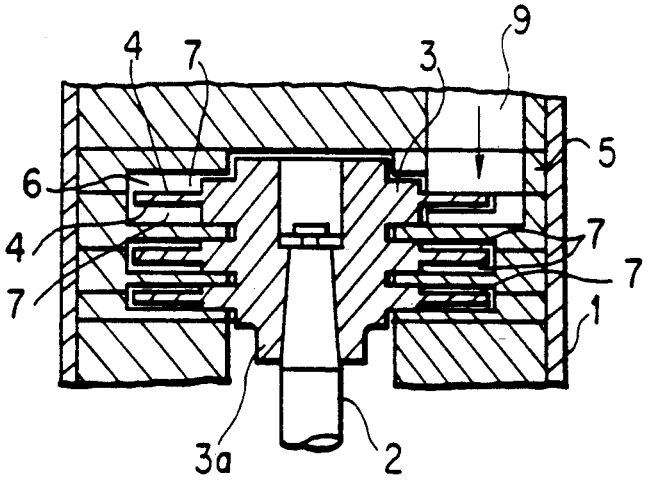
FIG. 16 is a sectional view taken on line XVI—XVI in FIG. 15.
Figure 17:
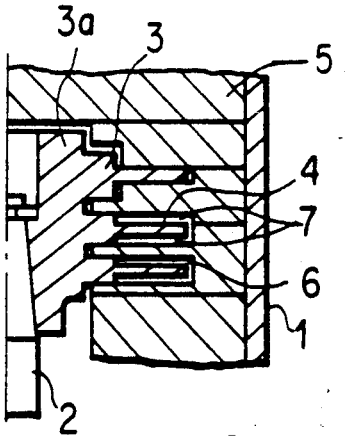
FIG. 17 is a sectional view taken on line O-XVII in FIG. 15.
Figure 18:
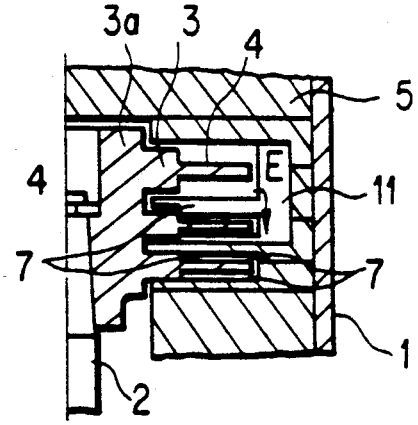
FIG. 18 is a sectional view taken on line O-XVIII in FIG. 15.
Figure 19:
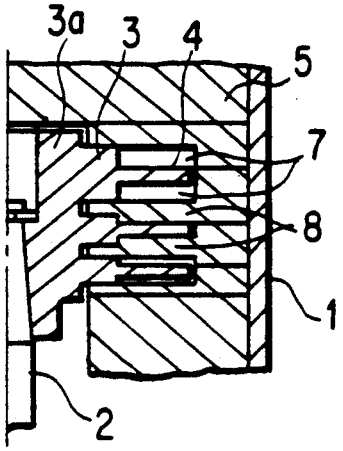
FIG. 19 is a sectional view taken on line O-XIX in FIG. 15.
Figure 20:
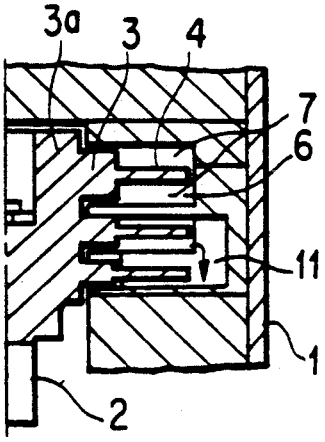
FIG. 20 is a sectional view taken on like O-XX in FIG. 15.

Third Embodiment (FIGS. 8 to 10)

A vacuum pump in a third embodiment is substantially the same in construction as the foregoing embodiments. In the vacuum pump in the third embodiment, the thickness of the peripheral portion of the rotor disk 3 corresponding to the steps 4 is decreased gradually toward the circumference, and the width of the annular groove 6 is decreased radially outward so that the thickness b of the flow passages 7, namely, the clearance between the steps 4 in the periphery of the rotor disk 3 and the corresponding surfaces of the annular groove 6, is the same at every position on the steps 4 with respect to the radial direction. Since the thickness of the peripheral portion of the rotor disk 3 corresponding to the steps 4 is decreased radially outward, the stress in the central portion of the rotor 3 induced by a centrifugal force acting on the rotor 3 is smaller than those induced in the rotors 3 of the foregoing embodiments, provided that the rotors 3 are the same in terms of rotating speed and size. Accordingly the rotor 3 of the vacuum pump in the third embodiment need not be formed of a material having a particularly high strength, but may be formed of an inexpensive material, such as engineering plastic or ceramics and may be formed by casting. Thus, the rotor disk 3 can be manufactured easily at a reduced manufacturing cost.

Fourth Embodiment (FIGS. 11 to 14)

A vacuum pump in a fourth embodiment is provided with two inlet ports 9 formed in the casing 1 respectively at diametrically opposite positions, two outlet ports 10 formed in the casing 1 respectively at diametrically opposite positions, and two pairs of partitions 8 disposed so as to partition the flow passages 7 into two sections at positions respectively between the inlet ports 9 and the adjacent outlet ports 10. Accordingly, a gas sucked into the casing is compressed and pumped in the two sections of the flow passages 7 partitioned by the two pairs of partitions 8, and hence the pumping speed of the vacuum pump is about twice that of the vacuum pumps in the foregoing embodiments. The vacuum pump may be provided with three or more pairs of partitions 8 to partition the flow passages 7 into three or more sections.

Fifth Embodiment (FIGS. 15 to 22)

A vacuum pump in a fifth embodiment according to the present invention is provided with three rotor disks 3 integrally combined in a single member having a boss 3*a*. The distances between the surfaces of each rotor disk 3 and the corresponding surfaces of stators 5 are decreased gradually from one end near the inlet port 9 toward the other end near the outlet port 10. Three pairs of partitions 8 are formed in the flow passages 7 for the three rotor disks 3 at angular intervals, and connecting ports 11 are formed between the adjacent flow passages 7 for the adjacent rotor disks 3 at angular intervals. A gas sucked into the casing 1 through the inlet port 9 is compressed in steps sequentially in flow passages 7 respectively for the three rotor disks 3 at a considerably high compression ratio. The compression ratio of the vacuum pump obtained through experiments was $10^3$ or higher. Although the vacuum pump in the fifth embodiment is a three-stage vacuum pump, the present invention is applicable also to multi-stage vacuum pumps having more than three compression stages for a still higher compression ratio.

Although the rotor disks 3 of the foregoing embodiments each have a reduced peripheral portion forming the steps 4, annular grooves may be formed in the side surfaces of the annular groove 6 of the stator 5 facing the peripheral portion of the rotor disk 3 without reducing the peripheral portion of the rotor disk 3.

In the foregoing embodiments, flow passages are formed respectively on both sides of the peripheral portion of each rotor disk and pressures in the flow passages at the same position on the rotor disk are the same. Therefore, the space between the circumference of the rotor disk and the bottom surface of the annular groove need not be sealed, and a large clearance may be formed between the circumference of the rotor disk and the bottom surface of the annular groove. Consequently, the components of the vacuum pump need not be machined with very high accuracy, the components can be machined easily and the vacuum pump can be constructed so as to be of a small size.

Sixth Embodiment (FIGS. 23 to 25)

A vacuum pump in a sixth embodiment according to the present invention is a compound molecular pump comprising a casing 1, a turbomolecular pump unit 12 disposed in the upper section of the casing 1, and a peripheral groove vacuum pump unit 13 The turbomolecular pump unit 12 comprises a rotor 14 integrally provided with numbers of rotor blades 12*a* extending from the body thereof, and numbers of stator blades 12*b* inwardly extending from the inner circumference of the casing 1. The vacuum pump unit 13 comprises four rotor disks 3 formed integrally with the rotor 14 so as to extend from the body of the rotor 14. The thickness of the upper rotor disk 3 is greater than that of the lower rotor disk 3. Both sides of the peripheral portion of each rotor disk 3 are cut partly to form steps 4. The depth of cut in the peripheral portion of the upper rotor disk 3 is greater than that of the lower rotor disk 3. Passages 7 are formed in a stator 5 respectively on the both sides of the peripheral portion of each rotor 3. The distance b between the surface of the rotor disk 3 and the corresponding surface of the stator 5, namely, the thickness of the flow passage 7, is greater for the upper rotor disk 3 and smaller for the lower rotor disk 3.

Similarly to the construction of the vacuum pump in the fifth embodiment, the terminating ends of the flow passages 7 for the upstream rotor disk 3 on the outlet side of a partition 8 communicate with the starting ends of the flow passages 7 for the downstream rotor disk 3 on the inlet side of the partition 8 by means of a connecting passage 11. The partitions 8 and the connecting passages 11 are arranged sequentially at angular intervals. The starting ends of the flow passages for the uppermost rotor disk 3 on the inlet side of the corresponding partition 8 communicate with an intermediate inlet port 15 communicating with the turbomolecular pump unit 12 as shown in FIG. 23, and the terminating ends of the flow passages for the lowermost rotor disk 3 on the outlet side of the corresponding partition 8 communicate with an outlet port 10 as shown in FIG. 25. A pipe connected to a backing pump is joined to the flange of an outlet pipe connected to the outlet port 10.

A rotor shaft 2 fixedly supporting the rotor 14 of the pump units 12 and 13 is supported in an upper bearing 16*a* fitted in the upper end of an inner tube 1*b* extending upward from a motor casing 1*a* disposed in the lower portion of the casing 1, and a lower bearing 16*b* provided on the bottom plate 1*c* of the motor casing 1*a*. The rotor 17*a* of a high-frequency motor 17, such as a high-frequency induction motor or a high-frequency hysteresis motor, is fixedly provided in the middle portion of the rotor shaft 2. The lower end of the rotor shaft 2 is immersed in a lubricating oil contained in an oil pan 18 attached to the bottom plate 1*c*. When the rotor shaft 2 rotates at a high rotating speed, the lubricating oil is delivered through an axial bore 2*a* and a radial bore 2*b* formed in the rotor shaft 2 to the upper bearing 16*a*. The lubricating oil is supplied to the lower bearing 16*b* through a groove formed in the inner circumference of the motor casing 1*a*.

Since the rotor 14 integrally comprises the rotor blades 12*a* of the turbomolecular pump unit 12, and the rotor disks 3 of the vacuum pump unit 13, only a relatively small amount of noise is generated when the rotor 14 rotates at a high rotating speed.

Operation of the compound molecular pump will be described hereinafter.

While the rotor 14 is driven for rotation at a high rotating speed by the high-frequency motor 17, a gas flows into the inlet port 9 in a molecular flow or a transition flow nearly the same as a molecular flow, and the molecules of the gas impinge against the rotating rotor blade 12*a* of the turbomolecular pump unit 12. Then, the gas is compressed and is caused to flow generally downward by the combined agency of the rotor blades 12*a* and the stator blades 12*b* extending from the casing 1, with a momentum having a component having a direction the same as the direction of rotation of the rotor blades 12*a* and a component having a downward direction parallel to the axis of the rotor shaft 2. The turbomolecular pump unit 12 requires a large accelerating torque for acceleration in the initial stage of operation to rotate the rotor 14 against wind loss attributable to a gas remaining therein in a high density and the moment of inertia of the rotor 14. Accordingly, the rotating speed of the rotor 14 is controlled by automatically limiting the input current of the motor 17 so that the input current will not increase excessively.

The gas thus compressed and transported by the turbomolecular pump unit 12 flows through the intermediate inlet port 15 into the vacuum pump unit 13. In the vacuum pump unit 13, the gas is compressed at a high compression ratio in a pressure range corresponding to the flow mode range of molecular flow mode to viscous flow mode and is caused to flow sequentially through the connecting passages 11 and the flow passages 7 for the rotor disks 3 as indicated by an arrow in FIG. 24 by the molecular drag effect of the steps 4 formed in the peripheral portions of the rotor disks 3 rotating at a high rotating speed of the vacuum pump unit 13. After being discharged through the outlet port 10, the compressed gas is further compressed to atmospheric pressure by the backing pump.

Figure 27:
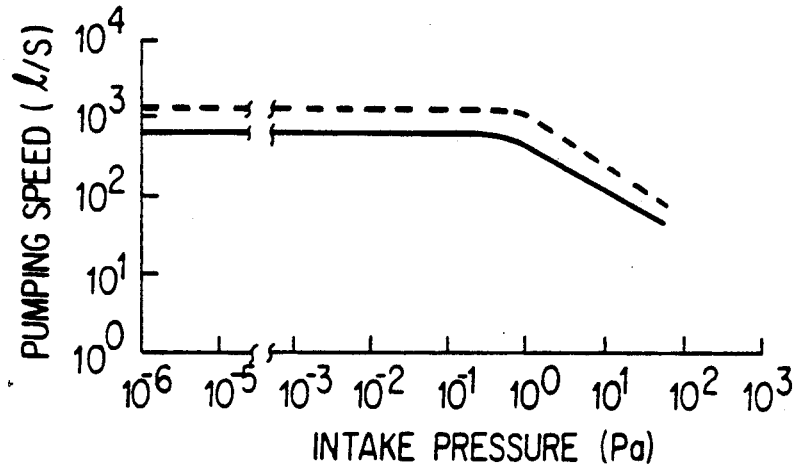
FIG. 27 is a graph showing the relation between intake pressure and pumping speed.
Figure 28:
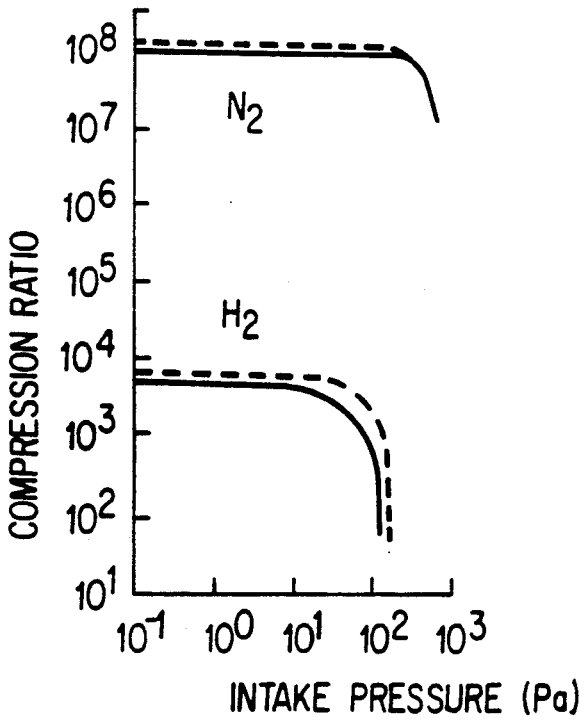
FIG. 28 is a graph showing the relation between intake pressure and compression ratio.

It was found through experiments that each compressing stage of a peripheral groove vacuum pump unit is able to compress the gas at a compression ratio of 10 in the flow mode range of molecular flow mode to viscous flow mode, and the gas can easily be compressed at a compression ratio of $10^4$ or higher by a vacuum pump of the same type having four compressing stages as the vacuum pump unit employed in the sixth embodiment. Indicated by solid lines in FIGS. 27 and 28 are the relation between pumping speed and intake pressure in pumping nitrogen gas ($N_2$) and the relation between intake pressure and compression ratio in pumping nitrogen gas ($N_2$) and hydrogen gas ($H_2$), respectively, by a conventional compound molecular pump, as shown in FIG. 26, comprising a casing i provided with an inlet port g and an outlet port h, a turbomolecular pump unit j disposed within the casing i on the side of the inlet port g, and a screw pump unit k disposed after the turbomolecular pump unit j. In FIGS. 27 and 28, the performance of the compound molecular pump in the sixth embodiment is indicated by broken lines for comparison. As is obvious from FIGS. 27 and 28, the performance of the compound molecular pump of the present invention is the same as or higher than that of the conventional compound molecular pump.

The compound molecular pump in the sixth embodiment does not need any special piping for connection because the flow passages 7 for the adjacent rotor disks 3 are communicate directly with each other by means of a connecting passage 11, and hence the space within the casing 1 can effectively be used. Furthermore, the axial length of the peripheral groove vacuum pump unit 13 of the compound molecular pump in the sixth embodiment is approximately one-third that of a screw pump unit having the same performance, the rotor 14 of the peripheral groove vacuum pump unit 13 is lightweight and has a moment of inertia far less than that of the screw pump unit.

Accordingly, the vacuum pump of the present invention does not require high accuracy for machining the component parts and can be manufactured at a reduced cost. Thus, the present invention is able to provide a compound molecular pump having a large capacity and a desirable performance.

Although the peripheral groove vacuum pump unit 13 of the sixth embodiment is provided with four rotor disks 3, the peripheral groove vacuum pump unit 13 may be provided with fewer rotor disks 3 depending on compression ratio requirement.

In the peripheral groove vacuum pump unit 13 of the sixth embodiment, the distance b between the surfaces of the rotor disk 3 and the corresponding surfaces of the stator 5 in the flow passages 7 may be decreased gradually from the starting ends toward the terminating ends of the flow passages 7 as in the second embodiment, the thickness of the peripheral portion of the rotor disk 3 having the steps 4 may be decreased gradually toward the circumference and the width of the annular groove 6 may be decreased gradually toward the bottom of the same so that the distance b between the steps 4 and the corresponding side surfaces of the annular groove 6 is the same at any radial position as in the third embodiment, or the casing 1 may be provided with a plurality of inlet ports 15 arranged at regular angular intervals, a plurality of outlet ports 10 arranged at regular angular intervals and a plurality of partitions 8 disposed at regular angular intervals at appropriate positions relative to the inlet ports 15 and the outlet ports 10 to compress and pump the gas in a plurality of sections of the flow passages 7.

Figure 30:
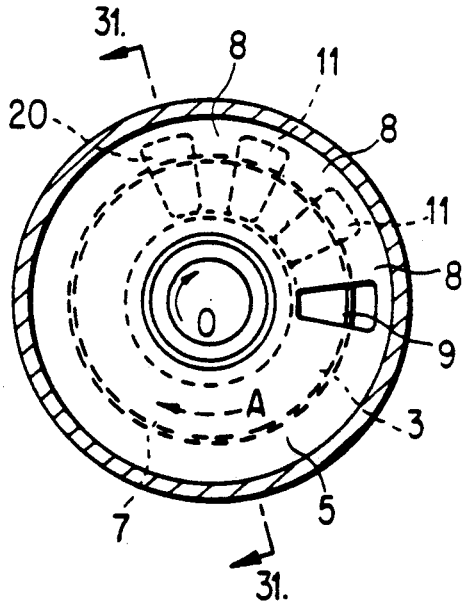
FIG. 30 is a sectional view taken on line XXX—XXX in FIG. 29.
Figure 29:
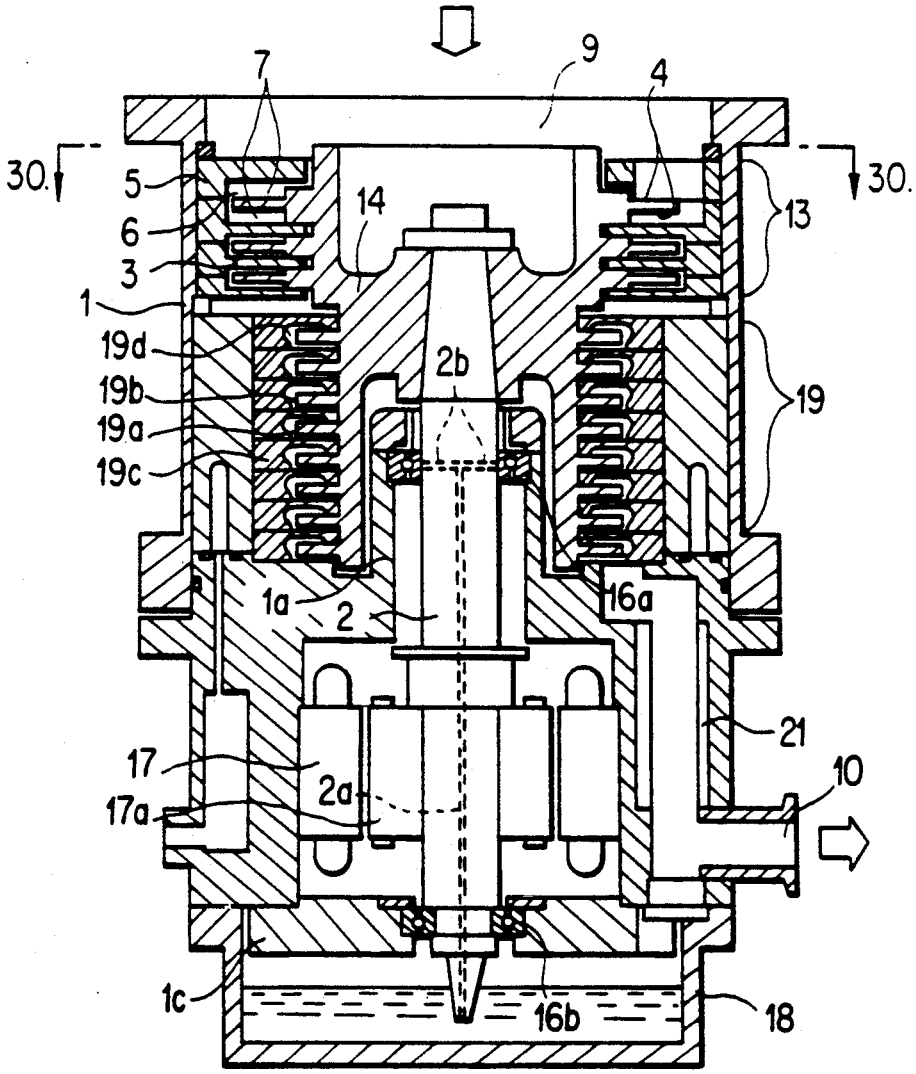
FIG. 29 is a general sectional view of a vacuum pump in a seventh embodiment according to the present invention.
Figure 31:
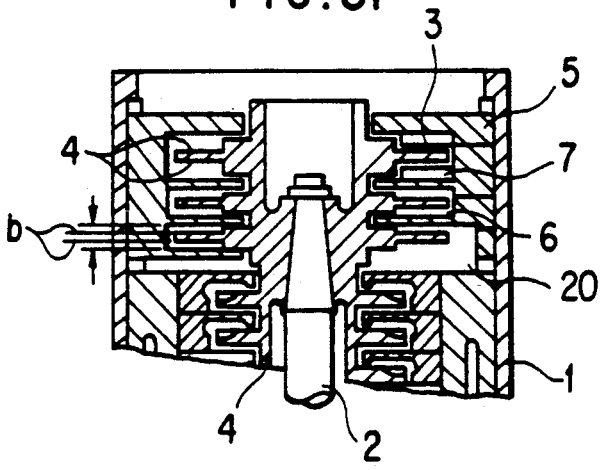
FIG. 31 is a sectional view taken on line XXXI—XXXI in FIG. 30.

Seventh Embodiment (FIGS. 29 to 31)

A vacuum pump in a seventh embodiment according to the present invention is a compound vacuum pump comprising a casing 1, a peripheral groove vacuum pump unit 13 disposed in the upper section of the casing 1, and a vortex vacuum pump unit 19 disposed in the lower section of the casing 1. The vacuum pump unit 13 and the vortex vacuum pump unit 19 have a common rotor 14. The rotor 14 is provided integrally with three rotor disks 3 for the peripheral groove vacuum pump unit 13, and eight rotor disks 19*a* for the vortex vacuum pump unit 19. The upper rotor disks 3 are greater than the lower rotor disks 3 in thickness as those in the fifth embodiment. The peripheral portion of each rotor disk 3 is cut to form steps 4 on both sides thereof. The upper rotor disks 3 are greater than the lower rotor disks 3 in terms of the depth of the steps 4, so that the distance b between the steps 4 of the upper rotor disks 3 and the corresponding surfaces of stators 5 in flow passages 7 is greater than that of the lower disks 3 accordingly. In the seventh embodiment, similarly to the fifth embodiment, the terminating ends of the flow passages 7 on the outlet side of a partition 8 for the upstream rotor disk 3 communicate with the starting ends of the flow passages 7 on the inlet side of a partition 8 for the downstream rotor disk 3 by means of a connecting passage 11. The partitions 8 respectively for the rotor disks 3 and the connecting passages 11 are arranged sequentially at angular intervals. The starting ends of the flow passages 7 for the uppermost rotor disk 3 on the inlet side of the partition 8 communicate with an inlet port 9 as shown in FIG. 29, and the terminating ends of the flow passages 7 for the lowermost rotor disk 3 on the outlet side of the partition 8 communicate with an intermediate outlet port 20 communicating with the vortex vacuum pump unit 19 as shown in FIG. 31.

The vortex vacuum pump unit 19 comprises eight rotor disks 19*c* each provided with radial recesses 19*b* in the peripheral portion thereof, and stators 19*c* each having a recess 19*d* receiving the peripheral portion of the corresponding rotor disk 19*a*.

Operation of this compound vacuum pump will be described hereinafter.

In the initial stage of operation, gas sucked through the inlet port 9 into the casing 1 as the rotor 14 is rotated at a high rotating speed by a high-frequency motor 17 flows in a turbulent flow and is compressed and pumped principally by the vortex vacuum pump unit 19 until the pressure at the inlet port is reduced to a pressure of about 1 kPa. In this stage, the gas flows merely through the flow passages 7 of the peripheral groove vacuum pump unit 13. After the inlet port pressure has decreased to a value in a pressure range corresponding to the flow mode range of viscous flow mode to molecular flow mode, the gas impinges against the surfaces of the steps 4 formed in the peripheral portion of the rotor disks 3 rotating at the highest surface speed. Then, the gas is caused to flow sequentially through the flow passages 7 via the connecting passages 11 as indicated by an arrow in FIG. 30 by a molecular drag effect resulting from friction between the molecules of the gas and the surfaces of steps 4, and is delivered through the intermediate outlet port 20 to the vortex vacuum pump unit 19 at a pressure exceeding 1 kPa. Then, the gas is compressed and pumped by the eight stages of the vortex vacuum pump unit 19 to the atmospheric pressure and is discharged through the outlet port 10.

Since the functional parts for compressing and discharging the gas of the compound vacuum pump do not include any parts in sliding contact, the functional parts require neither pump oil nor lubricating oil. Accordingly, the compound vacuum pump is able to create a clean and dry vacuum easily.

A flow passage leading to the outlet port 10 may be lined with a tubular diffuser 21 formed of a porous material, such as sponge, to suppress noise generated by the compound vacuum pump during operation.

Figure 32:
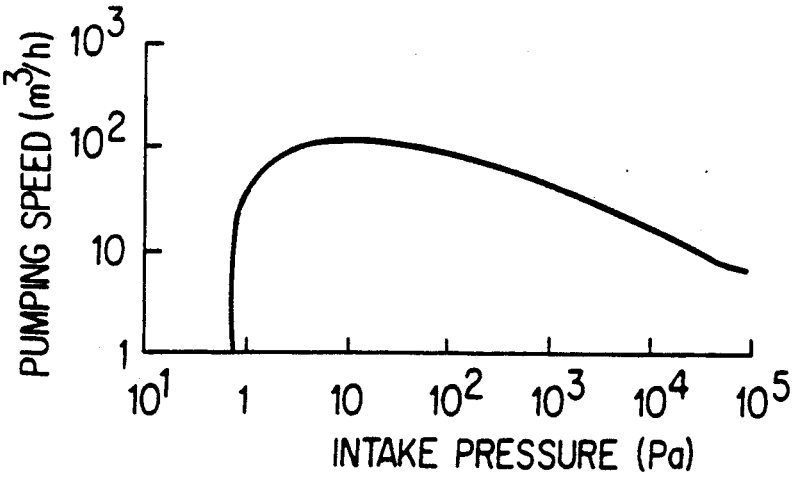
FIG. 32 is a graph showing the relation between intake pressure and pumping speed.

It was proved through experiments that the compound vacuum pump in the seventh embodiment having a compact and lightweight construction of 300 mm in outside diameter, 650 mm in height and about 90 kg in weight is capable of reducing the pressure of a system to an ultimate pressure of 1 Pa or below and is capable of operating at a pumping speed of 100 $m^3$/hr or above in the intake pressure range of 3 to 60 Pa as shown in FIG. 32. Thus, the compound vacuum pump having a performance of this type is very effectively applicable to a vacuum apparatus for a semiconductor device manufacturing process.

Furthermore, since the common rotor 14 is provided with both the rotor disks 3 of the peripheral groove vacuum pump unit 13 and the rotor disks 19*a* of the vortex vacuum pump unit 19, the dynamic balance of the rotor 14 can easily be adjusted and the rotor 14 rotates with the least amount of vibration. Since the outlet port 10 is disposed near the vortex vacuum pump unit 19 including the rotor disks 19*a* having radial recesses 19*b* and rotating at a high rotating speed, pulsation of the discharged gas is small and noise is scarcely generated. Still further, even if some solid particles are sucked into the compound vacuum pump during operation or even if solid particles are produced within the compound vacuum pump, the solid particles are caused to fly radially outward and are discharged from the compound vacuum pump together with the gas.

Although the compound vacuum pump in the seventh embodiment is provided with the peripheral groove vacuum pump unit 13 having the three rotor disks 3, the number of the rotor disks 3 may be varied optionally depending on required compression ratio.

In the peripheral groove vacuum pump unit 13 of the seventh embodiment, the distance b between the surfaces of the rotor disks 3 and the corresponding surfaces of the stators 5 in the flow passages 7 may be decreased gradually from the starting ends to the terminating ends of the flow passage 7 as in the second embodiment, the thickness of the peripheral portions of the rotor disks having the steps 4 may be decreased gradually toward the circumference and the width of the annular groove 6 may be decreased gradually toward the bottom so that the distance b between the steps 4 and the corresponding side surfaces of the annular groove 6 is the same at any radial position on the steps 4 as in the third embodiment, or the inlet port 9 and the outlet port 10 may be formed at a plurality of positions at regular angular intervals on the casing 1 and the flow passages 7 may be divided into a plurality of sections by a plurality of partitions 8 to compress and pump the gas in the plurality of sections of the flow passages 7 for each rotor disk 3 as in the fourth embodiment.

Figure 33:
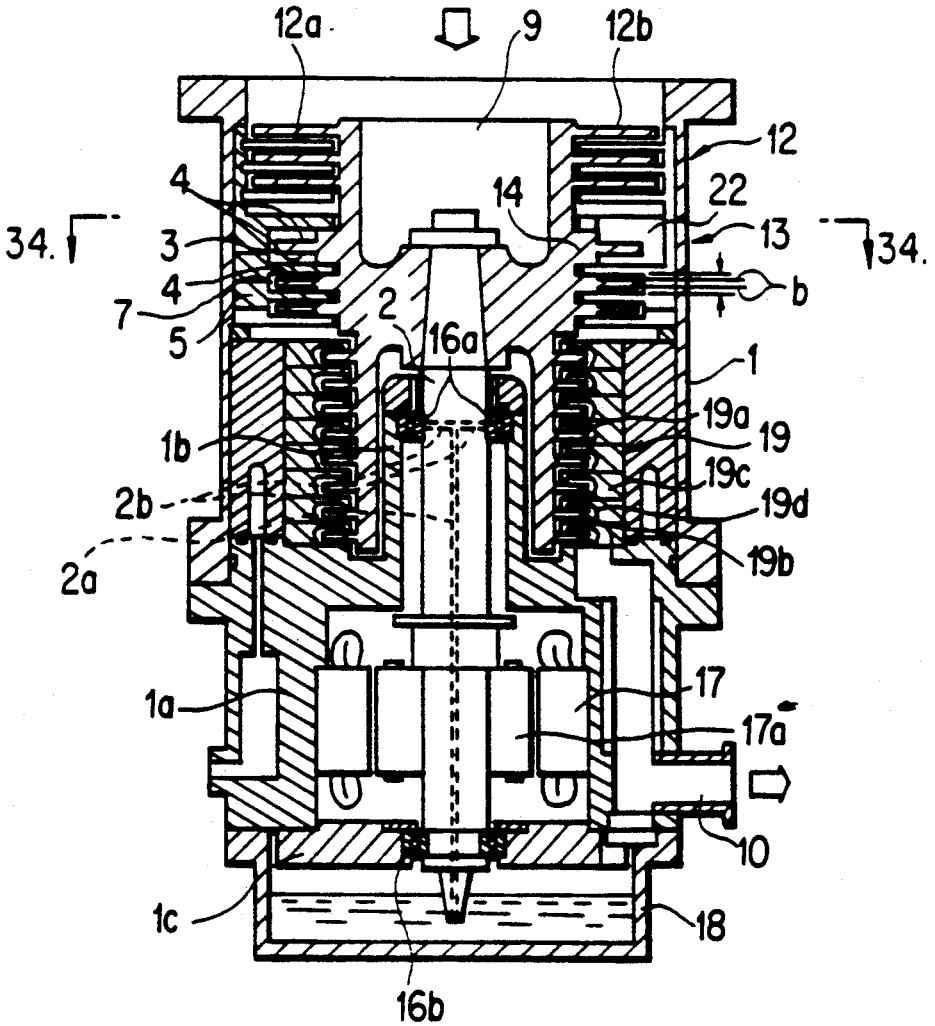
FIG. 33 is a general sectional view of a compound vacuum pump in an eighth embodiment according to the present invention.
Figure 34:
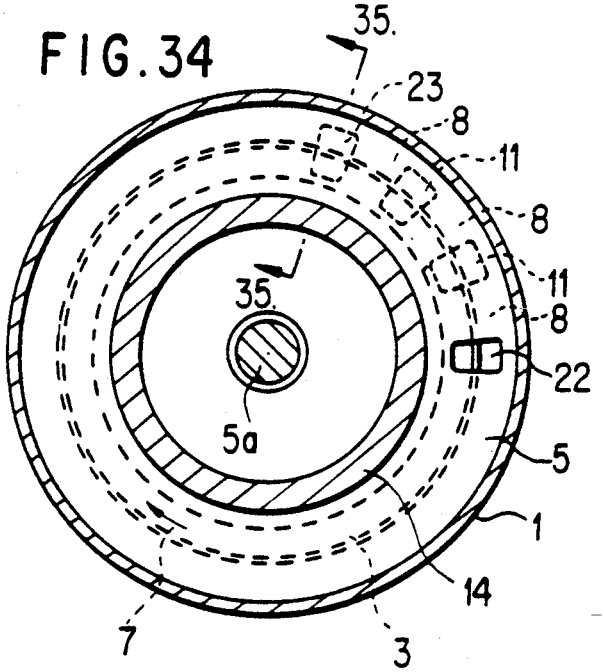
FIG. 34 is a sectional view taken on line XXXIV—XXXIV in FIG. 33.
Figure 35:
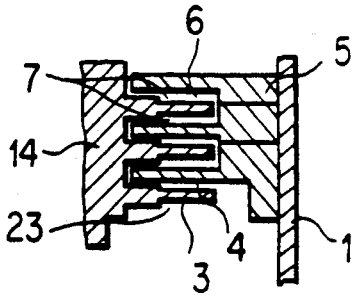
FIG. 35 is a sectional view taken on line XXXV—XXXV in FIG. 34.

Eighth Embodiment (FIGS. 33 to 35)

A vacuum pump in an eighth embodiment according to the present invention is a compound vacuum pump comprising a casing 1, a turbomolecular pump unit 12 disposed in the uppermost section of the casing 1, a peripheral groove pump unit 13 disposed in the middle section of the casing 1, and a vortex vacuum pump unit 19 disposed in the lowermost section of the casing 1. A common rotor 14 is provided integrally with a plurality of rotor blades 12*a* for the turbomolecular pump unit 12, three rotor disks 3*a* for the peripheral groove vacuum pump unit 13, and eight rotor disks 19*a* for the vortex vacuum pump unit 19. The turbomolecular pump unit 12 comprises a plurality of rotor blades 12*a* radially extending from the circumference of the rotor 14, and a plurality of stator blades 12*b* extending inward from the inner circumference of the casing 1. The peripheral groove vacuum pump 13 comprises an alternate arrangement of the three rotor disks 3 radially extending from the circumference of the rotor 14, and stators 5. The peripheral portions of the rotor disks 3 are cut to form steps 4 on both sides thereof, similarly to those of the fifth embodiment, so that the distance b between the surfaces of the steps 4 of the upper rotor disks 3 and the corresponding surfaces of the stators 5 in flow passages 7 is greater than that between the surfaces of the steps 4 of the lower rotor disks 3 and the corresponding surfaces of the stators 5 in flow passages 7.

Similarly to the flow passages 7 of the fifth embodiment, the terminating ends of the flow passages 7 for the upstream rotor disk 3 on the outlet side of a partition 8 communicate with the starting ends of the flow passages 7 for the downstream rotor disk 3 on the inlet side of a partition 8 by means of a connecting passage 11. The partitions 8 and the connecting passages 11 are arranged at angular intervals. The starting ends of the flow passages 7 for the uppermost rotor disk 3 on the inlet side of the partition 8 communicate with a first intermediate inlet port 22 communicating with the turbomolecular pump unit 12. The terminating ends of the flow passages 7 for the lowermost rotor disk 3 communicate with a second intermediate inlet port 23 communicating with the vortex vacuum pump unit 19.

Similarly to the vortex vacuum pump unit of the seventh embodiment, the vortex vacuum pump unit 19 comprises the eight rotor disks 19*a* extending from the circumference of the rotor 14 and each having the radial recesses 19*b*, and stators 19*c* defining flow passages 19*d*. The terminating end of the lowermost flow passage 19*d* communicates with an outlet port 10 as shown in FIG. 33.

Provided integrally with the rotor blades 12*a*, the rotor disks 3 and the rotor disk 19*a* respectively of the pump units 12, 13 and 19, the rotor 14 rotates at a high rotating speed with the least vibrations and the least noise.

Operation of the compound vacuum pump will be described hereinafter.

In the initial stage of operation after a high-frequency motor 17 has been actuated to drive the rotor 14 for rotation, a gas sucked into the casing 1 through the inlet port 9 flows in a turbulent and transition manner and the molecules of the gas impinge against the rotating rotor blades 12*a* of the turbomolecular pump unit 12. Then, the gas is compressed and is caused to flow downward by the combined agency of the rotor blades 12*a* and the stator blades 12*b* extending from the casing 1, with a momentum having a component having a direction the same as the direction of rotation of the rotor blades 12*a* and a component having a downward direction parallel to the axis of the rotor 14. The turbomolecular pump unit 12 requires a large torque for acceleration in the initial stage of operation to rotate the rotor 14 against wind loss attributable to a gas remaining therein in a high density and the moment of inertia of the rotor 14. The rotating speed of the rotor 14 is controlled so that the input current of the high-frequency motor 17 will not increase excessively.

The gas compressed and pumped by the turbomolecular pump unit 12 flows through the first intermediate inlet port 22 into the peripheral groove vacuum pump unit 13. In the peripheral groove vacuum pump unit 13, the gas is compressed at a high compression ratio in a pressure range corresponding to the flow mode range of molecular flow mode to viscous flow mode and is caused to flow sequentially through the connecting passages 11 and the flow passages 7 for the rotor disks 3 as indicated by an arrow in FIG. 34 by the molecular drag effect of the steps 4 formed in the peripheral portions of the rotor disks 3 of the peripheral groove vacuum pump unit 13 rotating at a high rotating speed. Then, the gas flows through the second intermediate inlet port 23 into the vortex vacuum pump unit 19, in which the gas is compressed by the agency of the rotor disks 19*a*. The compression ratio possible in one stage of the vortex vacuum pump unit 19 is in the range of 1.45 to 2.0. The compression ratio of a vortex vacuum pump unit having approximately ten stages is around 70. Thus, the gas of an intake pressure in the range of about 700 Pa (5.2 torr) to atmospheric pressure is compressed to atmospheric pressure by the vortex vacuum pump unit 19. Accordingly, the compound vacuum pump in the eighth embodiment is capable of pumping a vessel at atmospheric pressure at a high pumping speed to create an ultra-high vacuum.

Figure 36:
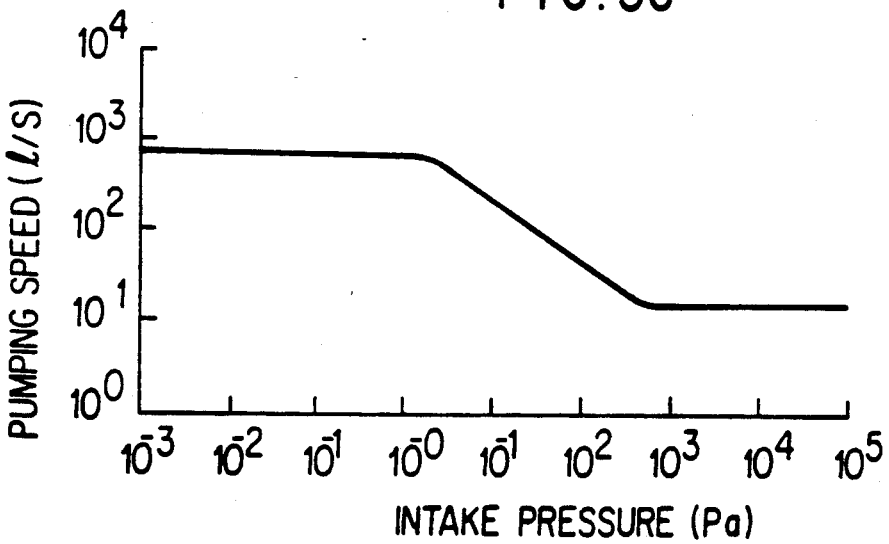
FIG. 36 is a graph showing the relation between intake pressure and pumping speed.

FIG. 36 shows a curve representing the relation between intake pressure and pumping speed obtained through experimental operation of the compound vacuum pump in the eighth embodiment, in which the outside diameter of the rotor blades 12*a* of the turbomolecular pump unit 12 is 200 mm, the peripheral groove vacuum pump unit 13 is a three-stage peripheral groove vacuum pump, and the outside diameter of the rotor disks 19*a* of the vortex vacuum pump unit 19 is 130 mm. The curve of FIG. 36 is substantially the same as a curve representing the relation between intake pressure and pumping speed for a conventional compound molecular pump comprising a turbomolecular pump unit and a screw pump unit arranged in that order from the inlet side to the outlet side of the compound molecular pump, and a backing pump connected to the compound molecular pump. Thus, the compound vacuum pump in the eighth embodiment is capable of pumping a gas at atmospheric pressure to create an ultra-high vacuum.

The axial length of the rotor 14 may be far smaller than that of the rotor of the conventional compound vacuum pump because the peripheral groove vacuum pump unit 12 has a high pumping performance. Provided integrally with the rotor blades 12*a* of the turbomolecular pump unit 12, the rotor disks 3 of the peripheral groove vacuum pump unit 13, and the rotor disks 19*a* of the vortex vacuum pump unit 19, and formed with a compact, lightweight construction, the rotor 14 is able to rotate with the least vibrations and does not require precision machining. Thus, the compound vacuum pump in the eighth embodiment is a compact, lightweight vacuum pump capable of creating a clean, dry vacuum. When the rotor 14 and the stators 12*b*, 5 and 19*c* are formed of an aluminum alloy and coated with a corrosion-resistant material, the compound vacuum pump is corrosion-resistant against corrosive gases and the lubricating oil is not contaminated. Since all the component pump units of the compound vacuum pump accelerate the gas in radial directions and the outlet ports are disposed on the circumferences of the pump units, the compound vacuum pump is able to operate smoothly even if solid particles are sucked into the compound vacuum pump together with the gas or even if solid particles ar produced by chemical reaction when the gas is compressed, because the solid particles are discharged outside through the outlet port. Thus, the compound vacuum pump can very effectively be applied to a vacuum apparatus for a semiconductor device manufacturing system.

The peripheral groove vacuum pump unit 13 may be provided with an optional number of rotor disks 3 depending on the required compression ratio.

In the peripheral groove vacuum pump 13 in the eighth embodiment, the distance b between the surfaces of the peripheral portions of the rotor disks 3 and the corresponding surfaces of the stators 5 in the flow passages 7 may be decreased gradually from the starting ends toward the terminating ends of the flow passages 7 as in the second embodiment, the thickness of the peripheral portions of the rotor disks 3 between the steps 4 may be decreased toward the circumference and the width of the annular grooves 6 may be decreased toward the bottom of the same so that the distance b between the surfaces of the steps 4 and the side surfaces of the annular groove 6 is the same at any radial position on the steps 4 a in the third embodiment or the inlet port 9 and the outlet port 10 may be provided at a plurality of positions at regular angular intervals and the partitions 8 may be provided at a plurality of positions for each rotor disk 3 at regular intervals to divide the flow passages 7 for each rotor disk 3 into a plurality of sections to compress and pump the gas in the plurality of sections by each rotor disk 3.

Figure 37:
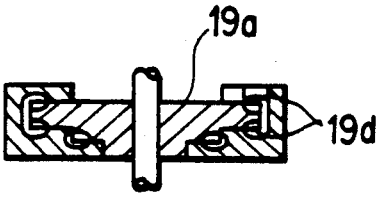
FIG. 37 is a longitudinal sectional view of a rotor employed in a first modification of the vortex vacuum pump unit of the compound vacuum pump in the eighth embodiment according to the present invention.

FIG. 37 shows a first modification of the vortex vacuum pump unit 19 of the compound vacuum pump in the eighth embodiment. This vortex vacuum pump unit has flow passages 19*d* formed on both sides of each rotor disk 19*a*. The sectional area of a flow passage for the next stage is 70% of the sectional area of the flow passages 19*d* formed on both sides of the precedent rotor disk 19*a*.

Figure 38:
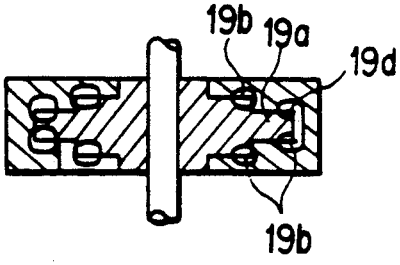
FIG. 38 is a longitudinal sectional view of a rotor employed in a second modification of the vortex vacuum pump unit of the compound vacuum pump in the eighth embodiment according to the present invention.

FIG. 38 shows a second modification of the vortex vacuum pump unit 19 of the compound vacuum pump in the eighth embodiment. This vortex vacuum pump unit employs a rotor disk 19*a* provided with recesses 19*b* on both sides thereof so that the rotor disk 19*a* serves as a four-stage pumping element.

A combination of the rotor disks of the first and second modifications of the vortex vacuum pump unit 19 shown in FIGS. 37 and 38 enables the reduction of the number of rotor disks of the vortex vacuum pump unit 19 substantially without reducing the capacity of the vortex vacuum pump unit 19.

Ninth Embodiment (FIGS. 39 to 42)

A vacuum pump in a ninth embodiment according to the present invention comprises a casing 1, a rotor consisting of a rotor shaft 2 and a rotor body 3*a* fixed to the rotor shaft 2 and provided integrally with two rotor disks 3, a stator 5 provided with two annular grooves formed so as to receive the rotor disks 3 therein, and partitions 8 projected from the stator 5 at the same angular positions in the annular grooves 6, respectively. The partitions 8 block flow passages 7 formed on both sides of the two rotor disks 3. The starting ends of the flow passages 7 for the rotor disks 3 on the upstream side of the partitions 8 communicate with an inlet port 9, and the terminating ends of the flow passages 7 for the rotor disks 3 on the downstream side of the partitions 8 communicate with an outlet port 10. The depth of the annular grooves 6 is determined so as to meet the inequality:

$$Kn=\lambda/b\geqq 4\times 10^{-3}$$

where Kn is the Knudsen number, λ is the mean free path of molecules of the gas and b is the distance between the surfaces of the rotor disks 3 and the corresponding side surfaces of the annular grooves 6 in the flow passages 7.

Figure 39:
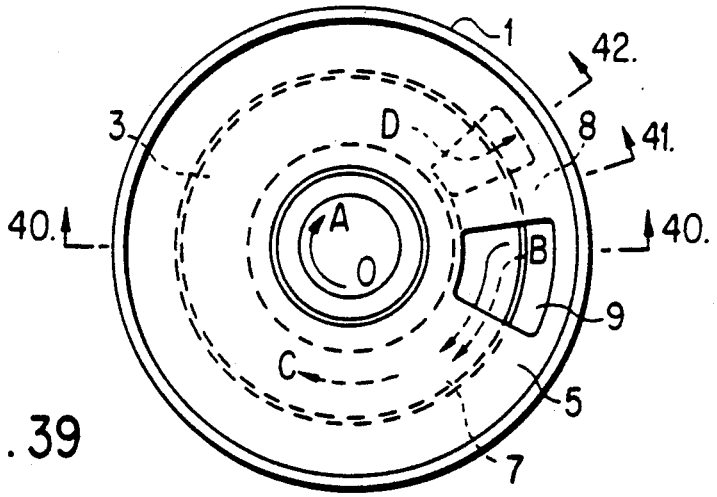
FIG. 39 is a plan view of an essential portion of a vacuum pump in a ninth embodiment according to the present invention.
Figure 40:
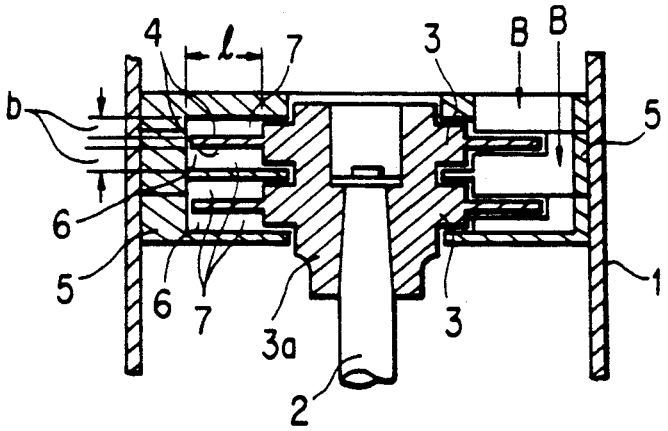
FIG. 40 is a sectional view taken on line XL—XL in FIG. 39.
Figure 41:
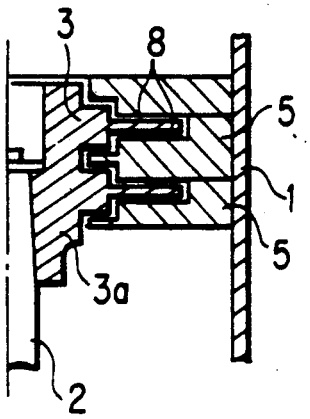
FIG. 41 is a sectional view taken on line O-XLI in FIG. 39.
Figure 42:
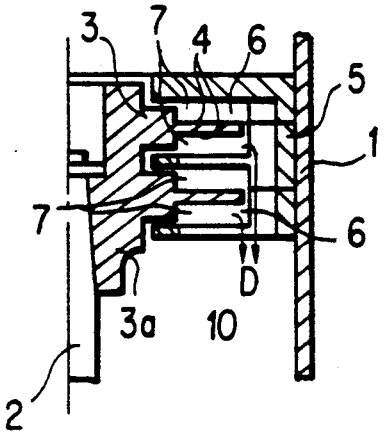
FIG. 42 is a sectional view taken on line O-XLII in FIG. 39.
Figure 44:
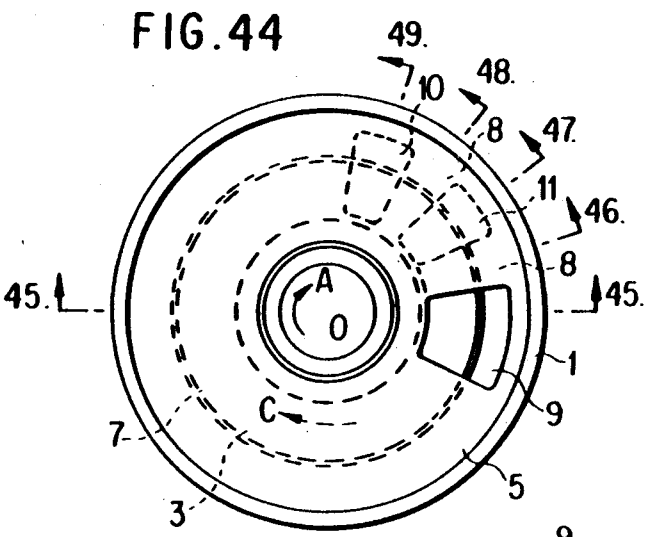
FIG. 44 is a plan view of an essential portion of a vacuum pump in a tenth embodiment according to the present invention.
Figure 45:
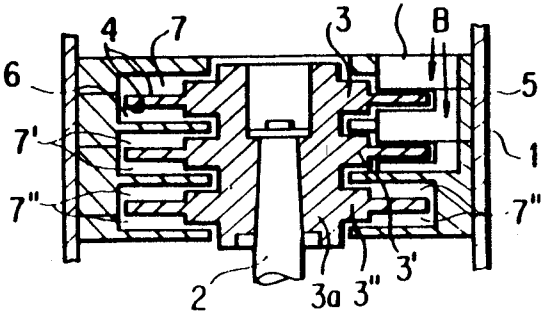
FIG. 45 is a sectional view taken on line XLV—XLV in FIG. 44.
Figure 43:
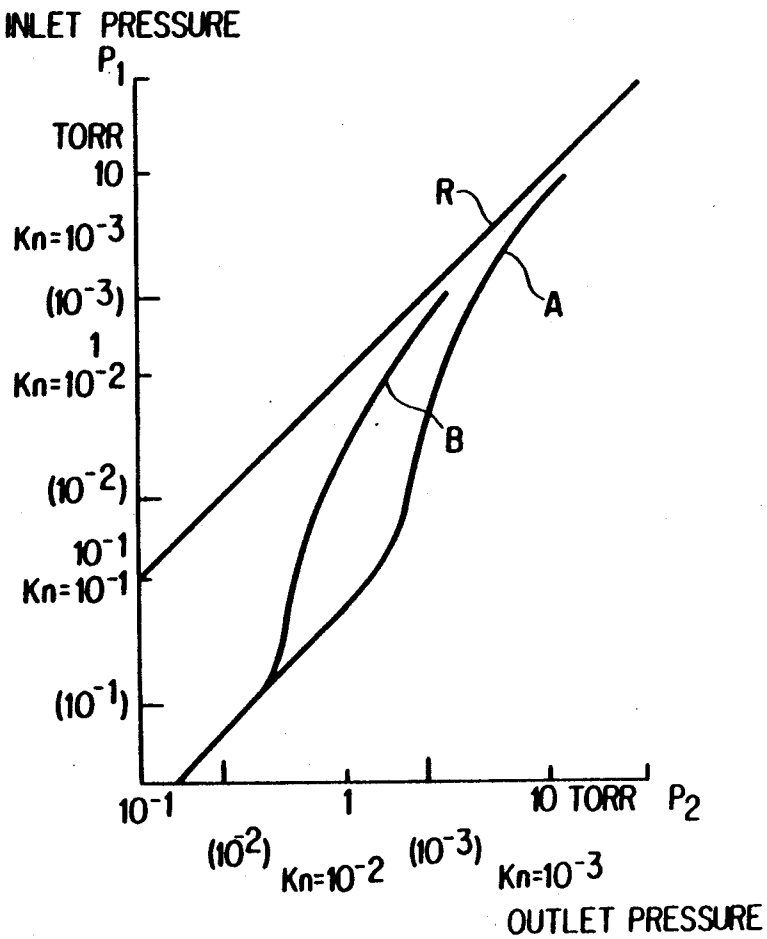
FIG. 43 is a graph showing compression characteristics.
Figure 46:
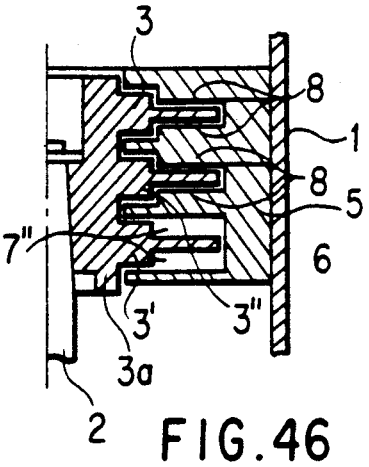
FIG. 46 is a sectional view taken on line O-XLVI in FIG. 44.
Figure 47:
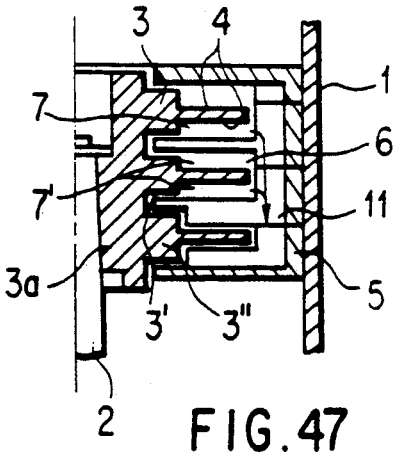
FIG. 47 is a sectional view taken on line O-XLVII in FIG. 44.
Figure 48:
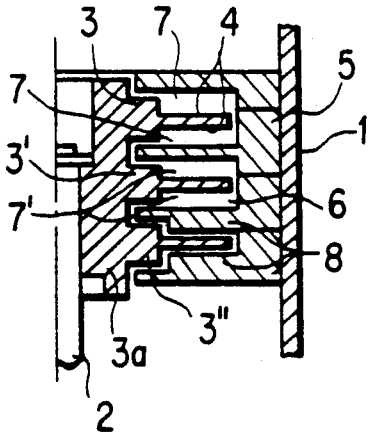
FIG. 48 is a sectional view taken on line O-XLVIII in FIG. 44.
Figure 49:
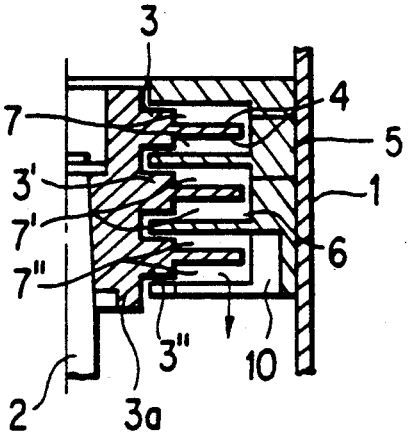
FIG. 49 is a sectional view taken on line O-XLVIX in FIG. 44.
Figure 50:
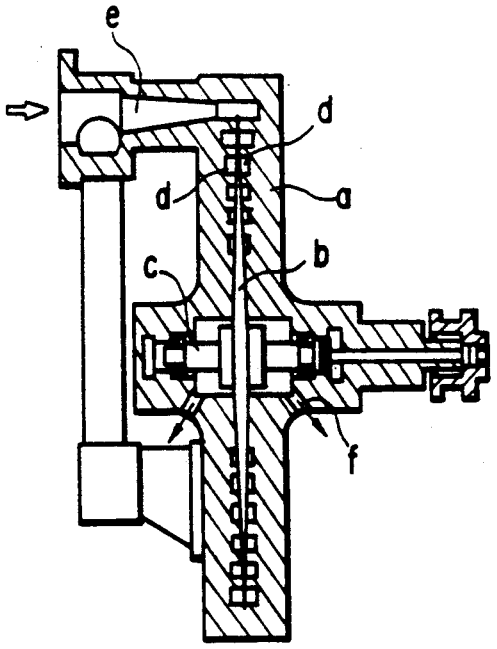
FIG.50 PRIOR ART
FIG. 50 is a sectional view of a conventional vacuum pump.

When the rotor disks 3 are driven by a motor for rotation in the direction of an arrow A (FIG. 39) at a high peripheral speed 0.1 to 1.0 times the arithmetic average velocity of molecules of the gas, molecules of the gas impinge on the surfaces of steps 4 formed in the peripheral portions of the rotor disks 3 in the flow passages 7 and molecules of the gas are transported by the molecular drag effect resulting from friction between the molecules. Thus, the gas is compressed within the flow passages 7 and is caused to flow through the inlet port 9 into the flow passages 7 as indicated by an arrow B (FIGS. 39 and 40), through the flow passages 7 as indicated by an arrow C (FIG. 39) and is discharged through the outlet port 10 as indicated by an arrow D (FIGS. 39 and 40). Thus, the peripheral groove vacuum pump is capable of pumping the gas in a flow mode in the range of molecular flow to viscous flow. FIG. 43 shows measured compression characteristics of the peripheral groove vacuum pump obtained through experiments.

In FIG. 43, measured inlet pressure $P_1$ is illustrated upon the influence of outlet pressure $P_2$. Curve A indicates compression characteristics of the peripheral groove vacuum pump when b=5 mm. On a straight line R, the intake pressure $P_1$ and a corresponding outlet pressure $P_2$ are the same, and hence the compression ratio is 1. Values of the Knudsen number Kn when b=5 mm are indicated on the vertical and horizontal coordinates. It is known from the curve A that the compression ratio is about 14 when $P_1\leqq 10^{-1}$ torr (13 Pa), 3 when $P_1=1$ torr (133 Pa), the compression performance falls sharply when the value of the Knudsen number Kn on the inlet side is in the range of $4\times 10^{-3}$ to $1\times 10^{-3}$, and the compression performance falls further and the compression ratio approaches 1 when the value of the Knudsen number Kn on the inlet side is below the lower limit of the foregoing range of the Knudsen number Kn.

In FIG. 43, curve B indicates the compression performance of the peripheral groove vacuum pump when b=20 mm. Values enclosed with brackets on alternate long and short dash lines are values of the Knudsen number Kn for the curve B. The pumping speed for the curve B is about four times that for the curve A. When the inlet pressure increases to a value to provide a value of Kn in the range of $4\times10^{-3}$ to $1\times10^{-3}$, the compression performance falls sharply. The compression performance falls further and the compression ratio approaches 1 when the value of Kn is below the lower limit of the foregoing range.

As is obvious from FIG. 43, the peripheral groove vacuum pump having the Kn of a value not less than $4\times10^{-3}$ in a flow mode range of molecular flow to viscous flow, provided with the rotor disks 3 in two stages and having the flow passages 7 connected in common to the inlet port 9 and the outlet port 10 is capable of operating at a comparatively high compression ratio and at a comparatively high pumping speed.

Tenth Embodiment (FIGS. 44 to 49)

A vacuum pump in a tenth embodiment according to the present invention is a peripheral groove vacuum pump comprising a casing 1, a rotor consisting of a rotor shaft 2, a rotor body 3*a* fixed to the upper end of the rotor shaft 2 and three rotor disks 3, 3' and 3'' formed integrally with the rotor body 3*a* in a sequential axial arrangement and having steps 4 formed by reducing the thickness of the peripheral portions thereof, and a stator 5 provided with annular grooves 6 respectively receiving the peripheral portions of the rotor disks 3, 3' and 3'' therein. Flow passages 7, 7' and 7'' are defined by the peripheral portions of the rotor disks 3, 3' and 3'' and the inner surfaces of the annular grooves 6 of the stator 5, respectively. The starting ends of the flow passages 7 and 7', namely, the ends on the side of an inlet port 9, for the uppermost rotor disk 3 and the middle rotor disk 3' communicate with the inlet port 9. The terminating ends of the flow passages 7 and 7', for the rotor disks 3 and 3' communicate with the flow passages 7'' for the lowermost rotor disk 3'' by means of a connecting passage 11 formed at an angular distance from the inlet port 9. The flow passages 7'' for the lowermost rotor disk 3'' communicate with an outlet port 10 formed at an angular distance from the connecting port 11. A gas sucked through the inlet port 9 into the peripheral groove vacuum pump is compressed successively in the flow passages 7, 7' and 7'' at a high compression ratio as the gas flows sequentially through the flow passages 7, 7' and 7''.

In either the ninth embodiment or the tenth embodiment, the flow passages for the two upstream rotor disks are connected in common to the inlet port. However, if necessary, the flow passages of the three or more successive upstream rotor disks may be connected in common to the inlet port to increase the pumping speed of the peripheral groove vacuum pump.

In the ninth embodiment or the tenth embodiment, the distance b between the surfaces of the peripheral portion of the rotor disk 3 and the corresponding side surfaces of the annular groove 6 of the stator 5 in the flow passages 7 may be decreased gradually from the starting ends toward the terminating ends of the flow passages 7 as in the second embodiment, the thickness of the peripheral portion of the rotor disk 3 having the steps 4 may be decreased gradually toward the circumference and the width of the annular groove 6 may be decreased gradually toward the bottom of the same so that the distance b between the surfaces of the step 4 and the corresponding side surfaces of the annular groove 6 is the same at any radial position on the steps 4 as in the third embodiment, or the inlet port 9 and the outlet port 10 may each be formed at a plurality of positions at regular angular intervals and partitions 8 may be provided at a plurality of positions to divide the flow passages 7 into a plurality of sections to compress and pump the gas in the plurality of sections by each rotor disk as in the fourth embodiment.

The peripheral groove vacuum pump in the ninth or tenth embodiment need not be used individually as a vacuum pump of the same pumping principle, but may be used in combination with high vacuum pumping elements or low vacuum pumping elements of different pumping principles in a coaxial arrangement to form a compound vacuum pump. For example, the application of the principle of the peripheral groove vacuum pump in the ninth or tenth embodiment to the peripheral groove vacuum pump unit of the compound vacuum pump in the sixth embodiment including the turbomolecular pump unit enhances the pumping speed of the peripheral groove vacuum pump unit, and hence the application of the principle of the peripheral groove pump in the ninth or tenth embodiment enhances the general performance of the compound vacuum pump when the same has a large capacity. The application of the principle of the peripheral groove vacuum pump in the ninth or tenth embodiment to the peripheral groove vacuum pump unit of the compound vacuum pump in the seventh embodiment including the vortex vacuum pump unit enhances the general performance of the compound vacuum pump. Furthermore, the application of the principle of the peripheral groove vacuum pump in the ninth or tenth embodiment to the peripheral groove vacuum pump unit of the compound vacuum pump including the turbomolecular pump and the vortex vacuum pump unit enhances the general performance of the compound vacuum pump.

Obviously, numerous modifications and variations of the present invention are possible in light of the above teachings. It is therefore to be understood that within the scope of the appended claims, the invention may be practiced otherwise than a specifically described herein.

What is new and desired to be secured by letters patent of the United States is:

1. A vacuum pump having a peripheral groove vacuum pump unit, which comprises:

a casing provided with an inlet port and an outlet port;

a rotor disposed within the casing and comprising a rotor shaft journaled on the casing, a rotor body fixed to the rotor shaft and provided integrally with a plurality of rotor disks;

a stator fixedly provided within the casing and provided with a plurality of annular grooves respectively receiving the peripheral portions of the rotor disks wherein both sides of the peripheral portion of each rotor disk comprise steps forming flow passages on both sides of the peripheral portion of the rotor disks wherein the steps are of substantially uniform width and are substantially planar along the entire surface thereof; and a plurality of partitions which project from the stator into the flow passages, wherein the terminating ends of the flow passages on the outlet side of the partition for the upper rotor disk, with respect to the flow direction of a gas sucked into the casing, among two adjacent rotor disks and the starting ends of the flow passages on the inlet side of the partition for the lower rotor disk, with respect to the flow direction of the gas, communicate with each other by means of at least one connecting passage, the starting ends of the flow passages on the inlet side of the partition for the uppermost rotor disk communicate with the inlet port, and the terminating ends of the flow passages on the outlet side of the partition for the lowermost rotor disk, with respect to the flow direction of the gas, communicate with the outlet port.

2. A vacuum pump according to claim 1, wherein the distance between the surfaces of the peripheral portion of each rotor disk and the corresponding inner surfaces of the annular groove of the stator is decreased gradually from the starting ends toward the terminating ends of the flow passages.

3. A vacuum pump having a peripheral groove vacuum pump unit, which comprises:

a casing provided with an inlet port and an outlet port;

a rotor disposed within the casing and comprising a rotor shaft journaled on the casing and a rotor body fixed to the rotor shaft and provided integrally with a plurality of rotor disks; and a stator fixedly disposed within the casing and provided with annular grooves receiving the peripheral portions of the rotor disks wherein the depth of the annular grooves is determined so as to meet the equation:

$$Kn = \lambda / b$$

wherein Kn is the Knudsen number, $\lambda$ is the mean free path of molecules of the gas at an operating pressure, and b is the distance between the surfaces of the peripheral portion of each rotor disk and the corresponding side surfaces of the annular groove of the stator in flow passages, Kn is not less than $4 \times 10^{-3}$, and the starting ends of the flow passages for two or more upper most rotor disks, with respect to the flow direction of the gas, are connected in common to the inlet port.

4. A vacuum pump having a peripheral groove vacuum pump unit, which comprises:

a casing provided with an inlet port and an outlet port;

a rotor disposed within the casing and comprising a rotor shaft journaled on the casing, a rotor body fixed to the rotor shaft and provided integrally with a plurality of rotor disks having peripheral portions cut in steps;

a stator fixedly provided within the casing and provided with a plurality of annular grooves respectively receiving the peripheral portions of the rotor disks wherein portions of the side walls of the annular groove corresponding to the peripheral portion of the rotor disk comprise annular recesses forming flow passages on both sides of the peripheral portion of the rotor disks wherein the steps are of substantially uniform width and are substantially planar along the entire surface thereof; and a plurality of partitions which project from the stator into the flow passages, wherein the terminating ends of the flow passages on the outlet side of the partition for the upper rotor disk, with respect to the flow direction of a gas sucked into the casing, among two adjacent rotor disks and the starting ends of the flow passages on the inlet side of the partition for the lower rotor disk, with respect to the flow direction of the gas, communicate with each other by means of a connecting passage, the starting ends of the flow passages on the inlet side of the partition for the uppermost rotor disk communicate with the inlet port, and the terminating ends of the flow passages on the outlet side of the partition for the lowermost rotor disk, with respect to the flow direction of the gas, communicate with the outlet port.

5. A vacuum pump according to claim 4, wherein the distance between the surfaces of the peripheral portion of each rotor disk and the corresponding inner surfaces of the annular groove of the stator is decreased gradually from the starting ends toward the terminating ends of the flow passages.

* * * * *

UNITED STATES PATENT AND TRADEMARK OFFICE

CERTIFICATE OF CORRECTION

PATENT NO. : 5,221,179

DATED : June 22, 1993

INVENTOR(S) : Tatsuji Ikegami et al.

It is certified that error appears in the above-indentified patent and that said Letters Patent is hereby corrected as shown below:

On the title page, Item [30] and [60],

The fifth Foreign Application Priority Data is incorrect, should read: --Dec. 16, 1988 [JP] Japan.....63-316227--

The Related U.S. Application Data is incorrect, should read: --Division of Ser. No. 582,783, Sep. 14, 1990, Patent No. 5,074,747, which is a Continuation of Ser. No. 379,072, Jul. 13, 1989, abandoned--

Signed and Sealed this

Seventh Day of June, 1994

Bruce Lehman

*Attest:*

BRUCE LEHMAN

*Attesting Officer*

*Commissioner of Patents and Trademarks*